US007037149B1

(12) United States Patent
Mauzy

(10) Patent No.: US 7,037,149 B1
(45) Date of Patent: May 2, 2006

(54) PEDAL POWERED CATAMARAN

(76) Inventor: Robert B. Mauzy, 438 Tanglewood Dr., Fort Walton Beach, FL (US) 32547

( * ) Notice: Subject to any disclaimer, the term of this patent is extended or adjusted under 35 U.S.C. 154(b) by 0 days.

(21) Appl. No.: 11/127,751

(22) Filed: May 13, 2005

(51) Int. Cl.
*B63H 16/20* (2006.01)

(52) U.S. Cl. ..... 440/27

(58) Field of Classification Search ..... 440/27
See application file for complete search history.

(56) References Cited

U.S. PATENT DOCUMENTS

| | | | | |
|---|---|---|---|---|
| 637,547 | A | 11/1899 | Clark | |
| 1,568,831 | A | 1/1926 | Hamme, Jr. | |
| 1,627,876 | A | 5/1927 | Williams | |
| 1,761,883 | A | 6/1930 | Froedtert | |
| 2,263,911 | A | 11/1941 | Wilson | |
| 2,287,706 | A | 6/1942 | Perry | |
| D151,382 | S | 10/1948 | Melton | |
| 2,751,876 | A | 6/1956 | Ogilvie | |
| D187,357 | S | 3/1960 | Silva | |
| 3,031,692 | A | 5/1962 | Riek | |
| 3,077,850 | A * | 2/1963 | Beuby | 114/281 |
| 3,083,382 | A | 4/1963 | Havens et al. | |
| 3,352,276 | A | 11/1967 | Zimmerman | |
| 3,640,239 | A | 2/1972 | Petroskey | |
| 4,140,076 | A * | 2/1979 | Borglum | 114/283 |
| 4,323,352 | A | 4/1982 | Warren et al. | |
| 4,459,116 | A | 7/1984 | Moore | |
| 4,648,846 | A | 3/1987 | Hsu | |
| 4,662,298 | A | 5/1987 | Strable | |
| 4,698,034 | A | 10/1987 | Anthonijsz | |
| 4,828,517 | A | 5/1989 | van Liefland | |
| 5,011,441 | A | 4/1991 | Foley et al. | |
| 5,061,215 | A * | 10/1991 | Walls | 441/45 |
| D321,854 | S | 11/1991 | Foley et al. | |
| 5,217,398 | A | 6/1993 | Meron et al. | |
| D345,136 | S | 3/1994 | Schlangen et al. | |
| 5,374,206 | A | 12/1994 | Gregory | |
| 5,405,275 | A | 4/1995 | Schlangen et al. | |
| D374,207 | S | 10/1996 | Peterson | |
| 5,651,706 | A | 7/1997 | Kasper | |
| 5,989,081 | A * | 11/1999 | Lekhtman | 440/27 |

* cited by examiner

*Primary Examiner*—Jesus D. Sotelo
(74) *Attorney, Agent, or Firm*—Peter Loffler

(57) ABSTRACT

A pedal powered catamaran has a pair of pontoons connected by a cross platform whereat an operator sits and rotates a pair of pedals which power the catamaran via a drive mechanism, the drive mechanism allowing the operator to gain mechanical advantage. One or both of the pontoons has a seat molded directly into the upper surface thereof in order to accommodate additional passengers onto the catamaran. Back rests and cup holds are also provided.

18 Claims, 2 Drawing Sheets

PEDAL POWERED CATAMARAN

BACKGROUND OF THE INVENTION

1. Field of the Invention

The present invention relates to a pedal powered catamaran wherein the operator is seated between the pontoons of the catamaran and wherein the pontoons have a seat thereon for additional passengers.

2. Background of the Prior Art

For people who love to be on the water, the exists a panoply of water vessels that can be used to get onto the water in order to satisfy the nautical urge. Such vessels range from a simple floating lounger or inner tube to a giant yacht or cruise ship and vessels of all sizes and types in between. While motor powered boats, large and small tend, to be fun and exhilarating, many small boats find favor with water going folks. One small boat that is enjoyed by many is the pedal boat, which typically comprises a small 4 or 5 seat boat that is pedaled by one or two folks in front seats with the pedaling driving a paddle that pushes the boat through the water. These boats, which are useful on lakes and other small bodies of water, are a great and inexpensive way to get onto the water. Although they do not travel very fast, they can still provide for a fun filled day.

Although pedal boats are quite fun and relatively straightforward to operate and maintain, their slow speed proves a limitation to some. Due to the architecture of a typical pedal boat, the pedals rotated by the pedallers directly drive the paddle wheel. As a result no mechanical advantage is gained by the operators. To overcome this lack of speed in pedal boats, pedal catamarans have been proposed. Such catamarans, while still relatively simple in design and thus relatively inexpensive so as to be affordable to those who want to enjoy the water at low cost, employ a drive system that gives the operators a mechanical advantage, thereby increasing the speed that can be achieved by the vessel, and effectively, the range. Such mechanical advantage is typically achieved by having the pedals operatively connected to either a paddle or a screw that drives the boat by either a chain drive or a gear drive, which drive provides the advantage. Many variations of pedal catamarans can be found in the art, and such catamarans are finding favor with a wide variety of water going people.

One limitation that present day catamarans have is the limited passenger capacity relative to the size of the vessel. Unlike a typical pedal boat, wherein the passengers are located above the pontoons of the boat, on a catamaran, the passengers are located on the platform that joins the pontoons of the vessel. As many pedal catamarans that achieve mechanical advantage have the drive seat—the seat or seats wherein the pedallers are seated—at the lateral midpoint of the platform, seating configuration for the other passengers can be tricky. While the width and/or length of the platform can be increased in order to provide more real estate for passengers, such catamaran expansion reduces the low cost advantage of this class of boats and also makes transport of the boat between home and the launch site more difficult.

Accordingly, there exists a need in the art for a catamaran that has a large passenger capacity to size ratio by utilizing the available surface real estate efficiently. Such a catamaran must be relatively low cost so that it serves as an entry level-type of boat for water lovers, while allowing for reasonable speed and range of the vessel. Such a catamaran must be relatively easy to load onto and transport by the transport vehicle that takes the boat between storage and launch site. Ideally, such a catamaran is of relatively simple design and construction and is simple to use and maintain.

SUMMARY OF THE INVENTION

The pedal powered catamaran of the present invention addresses the aforementioned needs in the art. The pedal powered catamaran is a large passenger capacity water vessel relative to its size ratio by utilizing the available surface real estate of the vessel efficiently. The pedal powered catamaran is relatively simple in design and construction making the boat relatively low cost allowing the boat to serve as an entry level-type of water vessel for water lovers. The pedal powered catamaran achieves mechanical advantage for its human provided drive motor, thereby allowing for reasonable speed and range of the vessel. The pedal powered catamaran is relatively easy to load onto and transport by the transport vehicle that takes the boat between storage and launch site. The pedal powered catamaran is simple to use and maintain.

The pedal powered catamaran is comprised of a first pontoon and a second pontoon that are joined by an appropriate cross platform. The catamaran has an appropriate a drive system for providing locomotive power to the catamaran, such as a single 10/1 gear box that drives a stainless steel shaft supported by carrier bearings turning a standard boat prop, and a steering system for steering the catamaran. A first seat is molded within an upper surface of the first pontoon while a second seat may be molded within an upper surface of the second pontoon. At least first one cup holder may be attached to the first pontoon and be located proximate the first seat while at least second one cup holder may be attached to the second pontoon and be located proximate the second seat. A first back rest may be located on the first pontoon and proximate and behind the first seat while a second back rest may be located on the second pontoon and proximate and behind the second seat.

BRIEF DESCRIPTION OF THE DRAWINGS

Similar reference numerals refer to similar parts throughout the several views of the drawings.

DESCRIPTION OF THE PREFERRED EMBODIMENT

Figure 1:
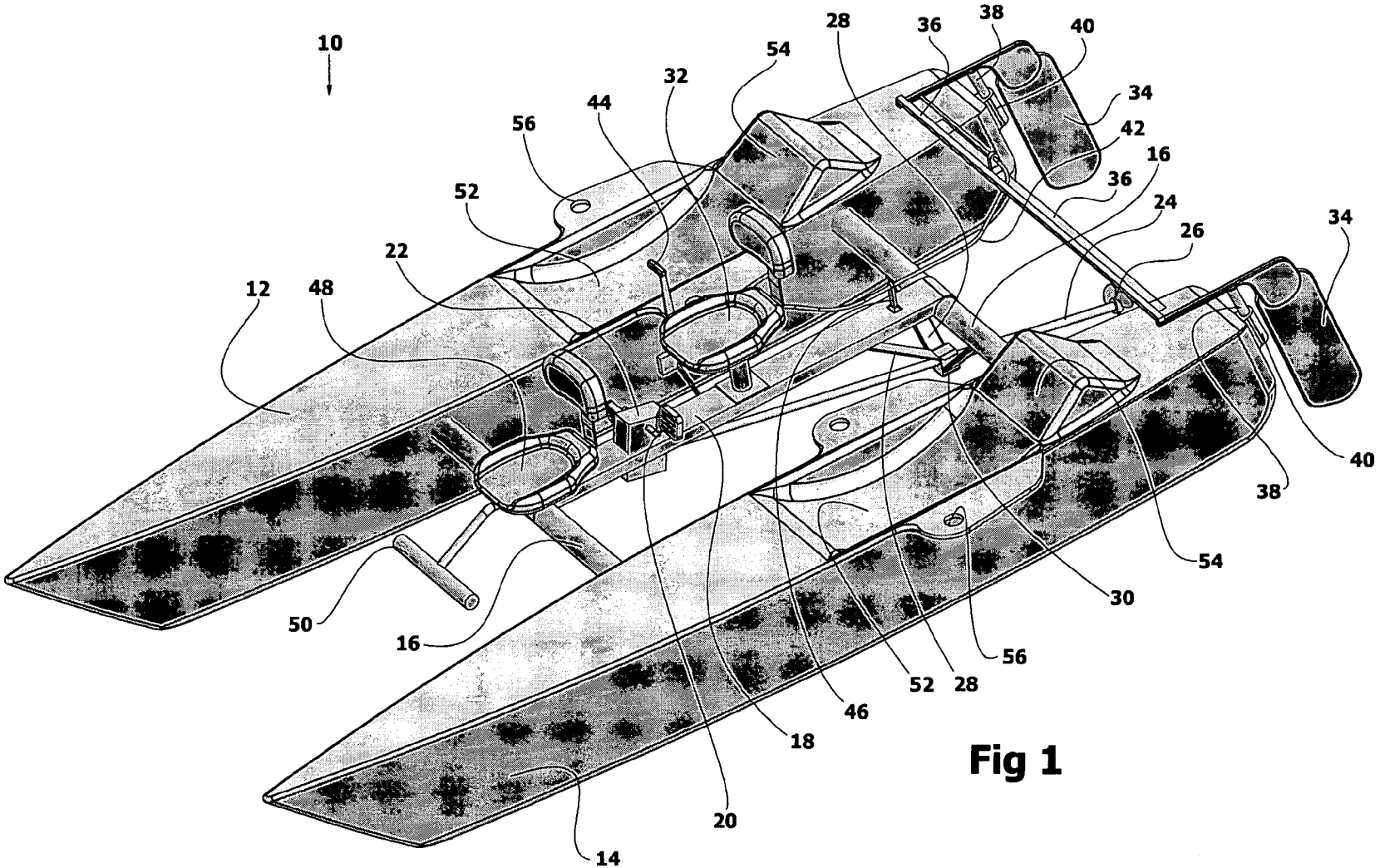
FIG. 1 is a perspective view of the pedal powered catamaran of the present invention.
Figure 2:
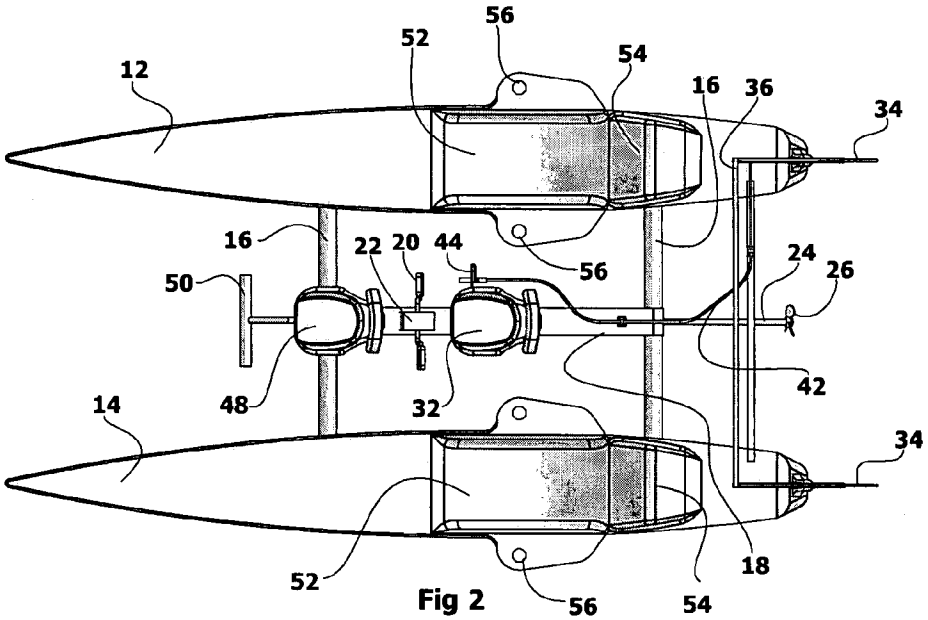
FIG. 2 is a top plan view of the pedal powered catamaran.
Figure 4:
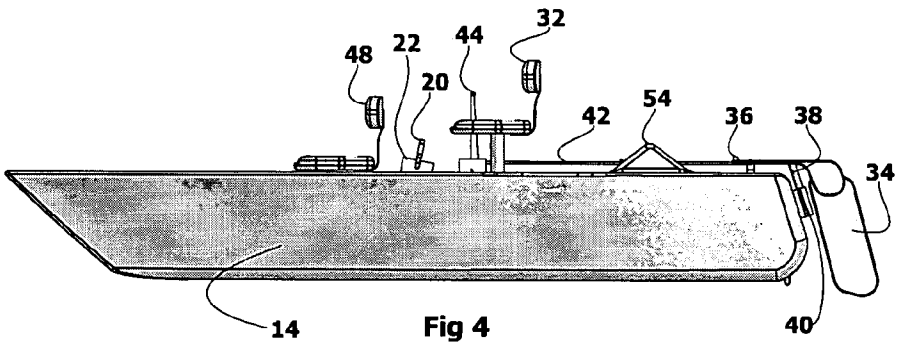
FIG. 4 is a front elevation view of the pedal powered catamaran.
Figure 3:
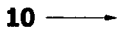
FIG. 3 is a front elevation view of the pedal powered catamaran.
Figure 3:
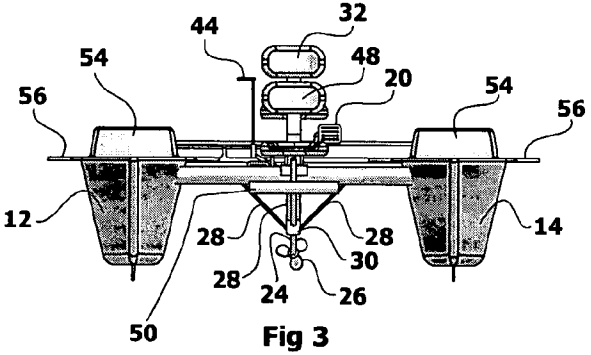

Referring now to the drawings, it is seen that the pedal powered catamaran of the present invention, generally denoted by reference numeral 10, is comprised of a first pontoon 12 and a second pontoon 14 joined by a platform that comprises a pair of cross members 16 with a base member 18 connecting the two cross members 16 (the base member 18 may extend entirely between the two pontoons 12 and 14). Other cross members can also be provided. As seen, a drive system comprises a pair of pedals 20 that rotate within a drive box 22. A drive shaft 24 extends rearwardly from the drive box 22 and terminates at a screw 26. Support struts 28 that have a shaft support 30 with appropriate carrier bearings can depend downwardly from the rear cross member 16 and/or the base member 18 in order to stabilize the drive shaft 24. The pedals 20 are operatively connected to the drive shaft 24 in order to rotate the drive shaft 24 in any desired manner known in the art such as by a chain connection, a gear connection such as a single 10/1 gear box (neither illustrated), etc. A seat 32 is located above the pedals 20 in order to allow an operator to sit therein and be able to reach and pedal the pedals 20. The seat 32 may, but need not be adjustable. As seen a pair of rudders 34 are connected to each other by a rudder linkage 36 that is rotatably connected to each of the pontoons 12 and 14 via a linkage post 38 that is rotatably received, removably or otherwise, within a post receiver 40. A cable 42 operatively connects a steering control arm 44 with the rudder linkage 36 such that pushing the steering control arm 44 forward causes the rudder linkage 42 to move in one direction and the rudders 34 in opposing direction (in the catamaran 10 illustrated, rudder linkage 36 starboard, rudders 34 port) and pulling back on the steering control arm 44 causes the rudder linkage 36 and the rudders 34 in to move in opposing direction (rudder linkage 36 port, rudders 34 starboard). A cable support 46 can be attached to the base member 18 and/or rear cross member 16 to help keep the cable 42 in place. A second seat 48 can be provided forward and/or rearward of the first seat 32 for holding a passenger, which second seat 48 may have a foot rest 50.

Each item of the catamaran 10 may be made from any appropriate material for the specific member with the pontoons 12 and 14 being made from an appropriate lightweight material such as plastic (rotomolded, etc.), an aramid fabric (KEVLAR, etc.), fiberglass, aluminum, etc., as may be the cross platform and the rudders. The drive shaft 24 and screw 26 may be made from stainless steel. The pontoons 12 and 14 may be sectioned with bulkheads (not illustrated) so that if a pontoon 12 or 14 develops a leak, that pontoon 12 or 14 will maintain partial buoyancy.

The above is illustrate of a typical pedal powered catamaran and changes in detail and architecture may be made while keeping with the scope and spirit of the present invention.

As seen, the first pontoon 12 and/or the second pontoon 14 may have a seat 52 thereat for holding additional passengers located amidships. Each seat 52 may be molded directly into the upper surface of the respective pontoon 12 or 14 and may have a back rest 54 positioned above the pontoon 12 or 14 for passenger comfort and may have one or more cup holders 56 in order to hold drinks for the passengers and possibly the pedaller of the catamaran 10. The cup holders 56 may be simple cutouts as illustrated, or may be more active grip type cup holders as known in the art.

By molding seats 52 directly into the pontoons 12 or 14 of the catamaran 10, the available surface real estate of the catamaran 10 is utilized efficiently and allows for additional passenger capacity without the need to either scrunch the passengers onto the cross platform or to increase the size of the cross platform. The architecture of the pedal powered catamaran 10 of the present invention allows for carrying of additional leisurely passengers without increasing the size of the catamaran 10 allowing the catamaran 10 to remain a relatively simple and straightforward water vessel that is easy to load and transport and to maintain and use. The back rest 54 can be attached to its respective pontoon 12 and 14 in any desired fashion, such as adhesive, screws, welding, etc.

The present invention can also be employed on trimarans wherein the two outbound pontoons and possibly the central pontoon have seats molded directly therein.

While the invention has been particularly shown and described with reference to an embodiment thereof, it will be appreciated by those skilled in the art that various changes in form and detail may be made without departing from the spirit and scope of the invention.

I claim:

1. A water vessel comprising:

a catamaran having a first pontoon having a first hull with a first outer sidewall and a second outer sidewall and a second pontoon having a second hull with a third outer sidewall and a fourth outer sidewall such that the first outer sidewall faces the third outer sidewall joined by a cross platform and having a pedal drive system for providing locomotive power to the catamaran and a steering system for steering the catamaran, the cross platform comprising a first cross member extending between the first sidewall and the third sidewall and a spaced apart second cross member extending between the first sidewall and the third sidewall and a base member extending between the first cross member and the second cross member and being spaced equidistantly between the first pontoon and the second pontoon;

a first chair extending upwardly from the base member; and a first seat located on the first pontoon.

2. The catamaran as in claim 1 further comprising at least one cup holder attached to the first pontoon and located proximate the first seat.

3. The catamaran as in claim 2 further comprising a back rest located on the first pontoon and proximate and behind the first seat.

4. The catamaran as in claim 1 further comprising a back rest located on the first pontoon and proximate and behind the first seat.

5. The catamaran as in claim 1 further comprising a second seat located on the second pontoon.

6. The catamaran as in claim 5 further comprising:

at least first one cup holder attached to the first pontoon and located proximate the first seat; and at least second one cup holder attached to the second pontoon and located proximate the second seat.

7. The catamaran as in claim 6 further comprising:

a first back rest located on the first pontoon and proximate and behind the first seat; and a second back rest located on the second pontoon and proximate and behind the second seat.

8. The catamaran as in claim 5 further comprising:

a first back rest located on the first pontoon and proximate and behind the first seat; and a second back rest located on the second pontoon and proximate and behind the second seat.

9. The catamaran as in claim 1 further comprising a second chair located on the base member forward of the first chair.

10. A water vessel comprising:

a catamaran having a first pontoon having a first hull with a first outer sidewall and a second outer sidewall and a second pontoon having a second hull with a third outer sidewall and a fourth outer sidewall such that the first outer sidewall faces the third outer sidewall joined by a cross platform and having a pedal drive system for providing locomotive power to the catamaran and a steering system for steering the catamaran, the cross platform comprising a first cross member extending between the first sidewall and the third sidewall and a spaced apart second cross member extending between the first sidewall and the third sidewall and a base member extending between the first cross member and the second cross member and being spaced equidistantly between the first pontoon and the second pontoon;

a first chair extending upwardly from the base member; and a first seat molded within an upper surface of the first pontoon.

11. The catamaran as in claim 10 further comprising at least one cup holder attached to the first pontoon and located proximate the first seat.

12. The catamaran as in claim 11 further comprising a back rest located on the first pontoon and proximate and behind the first seat.

13. The catamaran as in claim 10 further comprising a back rest located on the first pontoon and proximate and behind the first seat.

14. The catamaran as in claim 10 further comprising a second seat molded within an upper surface of the second pontoon.

15. The catamaran as in claim 14 further comprising:

at least first one cup holder attached to the first pontoon and located proximate the first seat; and at least second one cup holder attached to the second pontoon and located proximate the second seat.

16. The catamaran as in claim 15 further comprising:

a first back rest located on the first pontoon and proximate and behind the first seat; and a second back rest located on the second pontoon and proximate and behind the second seat.

17. The catamaran as in claim 14 further comprising:

a first back rest located on the first pontoon and proximate and behind the first seat; and a second back rest located on the second pontoon and proximate and behind the second seat.

18. The catamaran as in claim 10 further comprising a second chair located on the base member forward of the first chair.

* * * * *